US009822691B2

(12) United States Patent
Johansson et al.

(10) Patent No.: US 9,822,691 B2
(45) Date of Patent: Nov. 21, 2017

(54) METHOD AND SYSTEM FOR CONTROL OF A COOLING SYSTEM

(71) Applicant: SCANIA CV AB, Södertälje (SE)

(72) Inventors: Svante Johansson, Tullinge (SE); Sofie Jarelius, Huddinge (SE); Hans Wikström, Johanneshov (SE); Rickard Eriksson, Rönninge (SE)

(73) Assignee: SCANIA CV AB (SE)

( * ) Notice: Subject to any disclaimer, the term of this patent is extended or adjusted under 35 U.S.C. 154(b) by 56 days.

(21) Appl. No.: 14/784,347

(22) PCT Filed: Apr. 23, 2014

(86) PCT No.: PCT/SE2014/050483

§ 371 (c)(1),
(2) Date: Oct. 14, 2015

(87) PCT Pub. No.: WO2014/175812

PCT Pub. Date: Oct. 30, 2014

(65) Prior Publication Data

US 2016/0061093 A1 Mar. 3, 2016

(30) Foreign Application Priority Data

Apr. 25, 2013 (SE) ..... 1350514

(51) Int. Cl.
*F01P 11/14* (2006.01)
*F01P 7/04* (2006.01)
(Continued)

(52) U.S. Cl.
CPC ..... *F01P 11/14* (2013.01); *F01P 7/04* (2013.01); *F01P 7/10* (2013.01); *F01P 7/16* (2013.01);
(Continued)

(58) Field of Classification Search
CPC .... F01P 7/16; F01P 11/16; F01P 11/14; F01P 7/167; F01P 7/12; F01P 2025/66;
(Continued)

(56) References Cited

U.S. PATENT DOCUMENTS 7,347,168 B2 * 3/2008 Reckels ..... F01P 7/167 123/41.11
7,424,868 B2 * 9/2008 Reckels ..... F01P 7/167 123/41.1
(Continued)

FOREIGN PATENT DOCUMENTS

WO WO 2012079608 A1 6/2012

OTHER PUBLICATIONS

International Search Report dated Jul. 1, 2014 issued in corresponding International patent application No. PCT/SE2014/050483.

*Primary Examiner* — Long T Tran
(74) *Attorney, Agent, or Firm* — Ostrolenk Faber LLP

(57) ABSTRACT

A method and a system for controlling a vehicle cooling system includes: a velocity prediction unit makes a prediction of at least one future velocity profile $v_{pred}$ for the vehicle; a temperature prediction unit predicts at least one future temperature profile $T_{pred}$ for at least one component in the vehicle, based on at least tonnage for the vehicle; information related to a section of road ahead of the vehicle and on the at least one future velocity profile $v_{pred}$. A cooling system control unit controls the cooling system based on the at least one future temperature profile $T_{pred}$ and on a limit value temperature $T_{comp_lim}$ for the respective at least one component in the vehicle so that a number of fluctuations of an inlet temperature $T_{comp_fluid_in_radiator}$ for the cooling fluid flow into the radiator is reduced and/or so that a magnitude of the flow into the radiator is reduced when a temperature derivative dT/dt for the inlet temperature $T_{comp_fluid_in_radiator}$ exceeds a limit value $dT/dt_{lim}$ for the temperature derivative.

31 Claims, 7 Drawing Sheets

(51) Int. Cl.
*F01P 7/16* (2006.01)
*F01P 7/10* (2006.01)

(52) U.S. Cl.
CPC ..... *F01P 7/167* (2013.01); *F01P 2025/60* (2013.01); *F01P 2025/62* (2013.01); *F01P 2025/66* (2013.01); *F01P 2037/00* (2013.01)

(58) Field of Classification Search
CPC ..... F01P 2025/60; F01P 2037/00; F01P 2023/08; F01P 9/00; G01C 21/00; G01C 21/36
See application file for complete search history.

(56) References Cited

U.S. PATENT DOCUMENTS

| | | | | |
|---|---|---|---|---|
| 9,096,215 | B2 * | 8/2015 | Eriksson | F01P 7/165 |
| 2004/0055283 | A1 * | 3/2004 | Iihoshi | F01P 7/164 60/284 |
| 2007/0261648 | A1 * | 11/2007 | Reckels | F01P 7/167 123/41.12 |
| 2007/0272173 | A1 * | 11/2007 | Reckels | F01P 7/167 123/41.11 |
| 2009/0126656 | A1 | 5/2009 | Mounetou et al. | |
| 2011/0277477 | A1 * | 11/2011 | Filippone | F02B 41/00 60/645 |
| 2013/0261939 | A1 * | 10/2013 | McQuade | F02D 29/02 701/110 |

* cited by examiner

METHOD AND SYSTEM FOR CONTROL OF A COOLING SYSTEM

CROSS-REFERENCE TO RELATED APPLICATIONS

The present application is a 35 U.S.C. §§371 national phase conversion of PCT/SE2014/050483, filed Apr. 23, 2014, which claims priority of Swedish Patent Application No. 1350514-4, filed Apr. 25, 2013, the contents of which are incorporated by reference herein. The PCT International Application was published in the English language.

TECHNICAL FIELD OF THE INVENTION

The present invention concerns a method for controlling a cooling system in a vehicle, a system arranged to control a cooling system in a vehicle, and a computer program and a computer program product that implement the method according to the invention.

BACKGROUND OF THE INVENTION

The following background description of the present invention is not the prior art.

Cooling systems are necessary in vehicles with engines because the efficiency of the engines is limited. This limited efficiency means that not all the heat generated in the engines is converted into mechanical energy. The surplus generated heat must be conducted away from the engine in an efficient manner. Cooling systems for vehicles often utilize cooling fluid that is primarily comprised of a cooling medium, and typically contains water and an antifreeze, such as glycol, and/or an anti-corrosion agent.

FIG. 1 schematically depicts an engine 200 and a cooling system 400 in a vehicle 500. The cooling fluid can be circulated in the cooling system, in which the engine 200 and a radiator 100 are included in a cooling fluid loop. The surplus heat is transported via the loop from the engine 200 to the radiator 100. In the radiator 100 the heat is transferred from the primary cooling medium, cooling fluid, to the secondary cooling medium, air. The thick arrows 151, 152, 153, 154, 155, 156 in FIG. 1 indicate lines in which the cooling fluid is transported. The thin arrows illustrate connections 131, 132, 133, 134 between the cooling system and a control unit 300. The hollow arrows 161, 162, 163 illustrate the airflows, which are described below.

The cooling fluid thus passes through the engine 200 and is heated there by the surplus heat when the engine is hot. The cooling fluid 152 heated by the engine may also pass through one or a plurality of additional heat-generating components 210, such as a retarder brake, an exhaust recirculation device, a turbocharger, a dual turbocharger, a transmission, a compressor for a brake system, a device containing exhaust from the engine 200, a post-processing device for exhaust, an air-conditioning system or any other heat-generating component. All of these possible additional heat-generating components are depicted in FIG. 1 as a component 210 in series with the engine 200 along the cooling fluid line. However, the component 210 can be arranged as a number of different components, which can also be connected in series and/or in parallel with the engine 200 in the cooling fluid loop.

The cooling fluid is further heated by the one or a plurality of additional heat-generating components 210 before being transported further 153 to a thermostat 120. The thermostat 120 controls the flow Q of cooling fluid through the radiator 100. The thermostat 120 can be controlled 132 by a control unit 300. The thermostat guides, when appropriate, hot cooling fluid 154 to the radiator 100 and, when appropriate, cooling fluid past 155 the radiator 100 and supplies it to the cooling fluid line 156 leading from the radiator. The cooling fluid flows through the radiator 100 due to its circulation in the cooling fluid loop, which can be generated by means of a circulating pump 110. The radiator 100 is a heat exchanger, in which the ambient air, which is often forced through the radiator 100 by the headwind 161, 162, cools hot cooling fluid 154 as it passes through the radiator 100. The temperature of the cooling fluid is thereby reduced before it leaves the radiator 156 and continues 151 via a circulating pump 110 to the engine 200 to cool the engine and/or additional components 210, whereupon the cooling fluid becomes hotter again and begins its next circulation.

The cooling system thus often comprises a circulating pump 110, which drives the circulation of the cooling fluid in the cooling system. The pump 110 can be controlled 131 by a control unit 300 based, for example, on a current engine rpm, or on other suitable parameters. The cooling fluid is pumped 151 further to the engine 200. The cooling system 400 also often comprises a fan 130, which can be driven by a fan motor (not shown), or by the engine 200, sometimes via the circulating pump 110. In FIG. 1 the fan 130 is drawn schematically in front of the radiator 100, i.e. upstream of the radiator as viewed in the direction of flow of the airflow. However, the fan 130 can also be disposed behind the radiator 100, i.e. downstream of the radiator 100. The fan 130 creates an airflow 163, which helps to push/draw the air through the radiator 100 in order to increase the efficiency of the radiator 100. The fan can be controlled 133 by a control unit 300. The cooling system 400 can also comprise one or a plurality of radiator blinds or louvers 140, which can be opened entirely or partly in order to control the flow of ambient air/headwind 162 that reaches the radiator 100. The one or a plurality of radiator blinds 140 can be controlled 134 by the control unit 300. The efficiency of the radiator 100 can thus, in addition to control by means of the circulating pump 110, also be controlled by opening or closing one or a plurality of radiator blinds 140 and/or by utilizing the fan 130.

Controlling a cooling system based on positioning information and a prediction of upcoming cooling needs with the intention of reducing fuel consumption in a vehicle that contains the cooling system is known, e.g. via US2007/0261648.

BRIEF DESCRIPTION OF THE INVENTION

Prior art solutions have a problem in that they do not take into account how such control affects the radiator itself and/or the cooling system itself.

The radiator 100 contains a number of channels and/or tubes which, when the engine 200 is hot, are heated by the internal/primary flow, i.e. the cooling fluid, and cooled by the external/secondary flow, i.e. the ambient air. The temperature of the channels/tubes is determined by these two interworking flows. Because neither the internal nor the external flow is completely uniformly distributed over the radiator 100, the temperatures of different channels/tubes are mutually different.

The materials of the channels/tubes, which can consist of e.g. copper or aluminum, is affected by the temperature in such a way that the lengths of the channels/tubes expand mutually differently with increasing temperatures. This induces strain in the material of the channels/tubes, which leads to stresses on the radiator 100. This thus imposes a thermal load on the cooling system, and particularly on the radiator 100, thus shortening its service life. Typically, the greatest changes in temperature, i.e. when a cold radiator becomes hot and/or a completely closed thermostat 120 opens, also cause the greatest changes in strain. The radiator 100 can withstand only a limited number of major changes in temperature and/or flow before its function is degraded.

One object of the invention is consequently to reduce the thermal load on the cooling system and thereby achieve greater robustness for the components involved in the cooling system.

This object is achieved by means of the method herein, by the system herein and by a computer program and computer program product herein.

Tests have shown that it is primarily the number of changes in the magnitude, frequency and direction of the material strains that cause the harmful stresses in the radiator 100. These changes in stress are thus caused by changes in the internal flow, i.e. the cooling fluid, and in the external flow, i.e. the ambient air, and by the amplitude and frequency of the temperature changes.

The volume and speed of the internal flow is determined by the thermostat 120 and by the rpm of the water pump 110. The temperature of the internal flow is determined by the thermal flows in the cooling system, e.g. the engine load and utilization of exhaust brakes and retarder brakes. The external flow is determined by the rpm of the fan 130, the headwind 161 and/or the degree of opening/closing of the radiator blinds 140.

Through utilization of the present invention, the internal and/or external flows are controlled to reduce wear on the radiator 100 and/or other components in the cooling system. The adjustable actuators in the cooling system 400 are thus adjusted to reduce the degrading effects on the cooling system 400. For example, the thermostat 120, the water pump 110, the fan 130 and/or the radiator blinds 140 can be adjusted so that the magnitude, frequency and/or direction of changes in the material strains are reduced. The service life of the radiator 100 and/or the cooling system components is thereby extended.

The number of changes in the cooling fluid flow and the cooling fluid flow temperature is thus reduced through utilization of the present invention. The number of changes in the cooling fluid flow is controlled actively by means of the thermostat 120. This can be achieved via an analysis of at least one future temperature profile $T_{pred}$ for a temperature for one or a plurality of components, and of a limit value temperature $T_{comp_lim}$ for the one or a plurality of components in the cooling system. The greatest changes in temperature, e.g. when a closed thermostat 120 opens and a cold radiator 100 becomes hot, can be reduced and/or avoided by means of this analysis.

In this document the thermostat 120 can be closed, i.e. the thermostat has a degree of opening/thermostat position corresponding to the flow through the thermostat to the radiator 100 being equal to zero; Q=0, or it can be open, i.e. the flow Q through the thermostat 120 to the radiator 100 is greater than zero; Q>0. When the thermostat 120 is open, the flow Q can thus range all the way from very low, when the thermostat 120 is almost closed, to high, when the thermostat 120 is fully open.

Changes in the cooling fluid flow between two open positions for the thermostat, e.g. from 100 l/min to 150 l/min, produce a considerably smaller change in radiator temperature, and consequently also produce a considerably lower thermal load on the radiator and/or the cooling system than do changes between a fully closed and a fully open position of thermostat 120. Consequently, it is mainly such changes between two open thermostat positions for the cooling fluid flow that are utilized in controlling the cooling system according to the invention. A relatively small change in the cooling fluid flow from a closed position, e.g. a change from 0 l/min to 20 l/min, produces a greater change in the radiator temperature than does a relatively large change between two open positions, e.g. the aforementioned change from 100 l/min to 150 l/min. This is because the radiator 100 is cooled to the temperature of the ambient air when the thermostat 120 is closed, whereupon the temperature of the ambient air is often considerably lower than the cooling fluid temperature.

The control of the cooling system 400, i.e. the logic for the cooling system, is thus designed based on a prediction of the future load of the cooling system, whereby the number of major changes in thermostat position/degree of openness is minimized. According to the present invention, the number of changes from closed to some open position of the thermostat 120 is minimized in particular. In this document the term open position/thermostat refers, as noted above, to an at least partly open position/thermostat, i.e. essentially all degrees of openness from a position/thermostat that is scarcely open to a fully open position/thermostat.

According to one embodiment, the control of the cooling system 400 is also designed based on a prediction of components that could yield high power in an energy exchange with the cooling loop, such as a prediction of retarder use, heavy demand on the engine and/or exhaust braking, so that the thermostat 120 opens in controlled fashion before the cooling fluid temperature is able to increase, e.g. in connection with an energy exchange with the retarder oil cooler. The magnitude of the change and the thermal load on the cooling fluid radiator when the cooling fluid thermostat goes from a closed to open or half-open position are thereby reduced.

According to one embodiment, the radiator blinds 140 can also be controlled so that the airflow through the radiator is minimized when the thermostat is opened in order to achieve a reduced derivative of the cooling fluid temperature $T_{comp_fluid_radiator}$ in the radiator 100.

According to one embodiment, the control of the cooling system can be designed so that the cooling fan is not allowed to start unless the thermostat has reached its fully open position, whereby the effect of the external disuniformity in the radiator 100 is minimized. This is because only some cooling channels/tubes and/or certain parts of the cooling channels/tubes in the radiator will be able to become heated if the fan 130 is activated during the time the thermostat 120 is about to open, as the increased airflow produced by the fan causes a very powerful cooling effect.

BRIEF LIST OF FIGURES

The invention will be elucidated in greater detail with the help of the accompanying drawings, in which the same reference designations are used for the same parts, and wherein:

FIG. 1 schematically shows a vehicle containing a cooling system,

DESCRIPTION OF PREFERRED EMBODIMENTS

Figure 2:
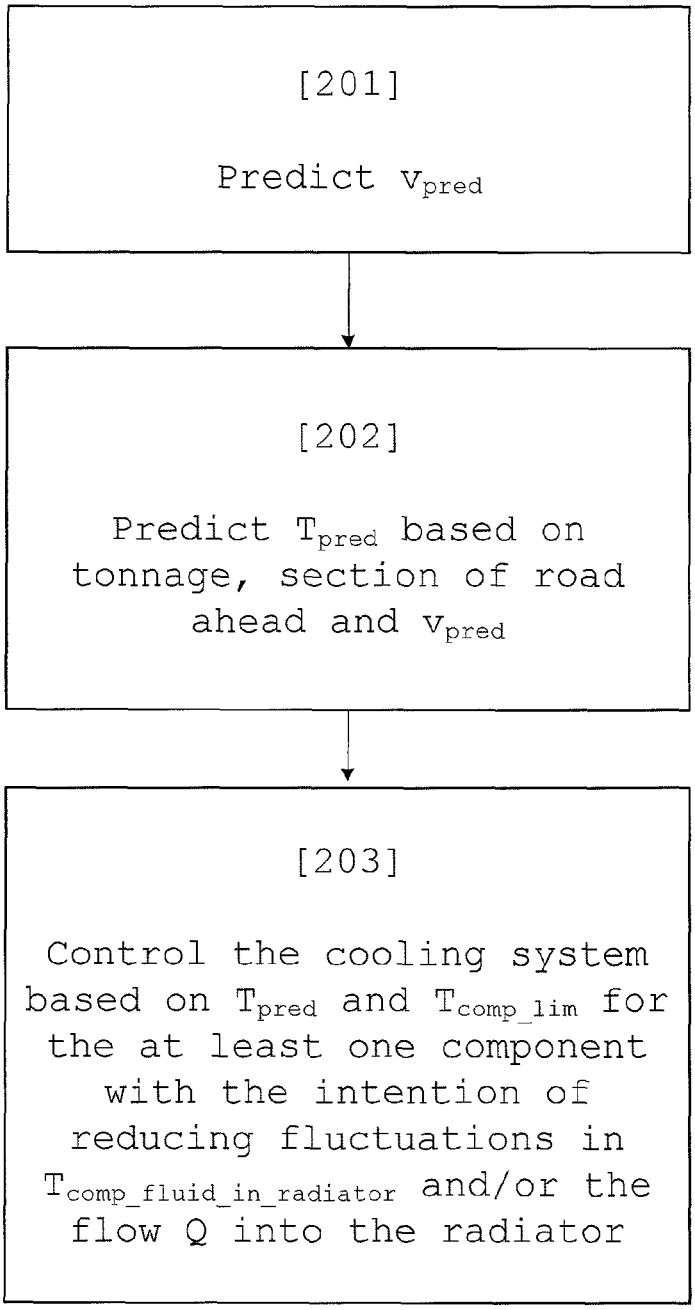
FIG. 2 shows a flow diagram for the invention.

FIG. 2 shows a flow diagram for the method according to the present invention. In a first step 201 of the method, a prediction of at least one future velocity profile $v_{pred}$ for a velocity of the vehicle that contains the control system is performed, e.g. by a velocity prediction unit 301 in the control unit 300. The one or a plurality of velocity profiles $v_{pred}$ are predicted for a section of road ahead of the vehicle, and can be based on information related to the upcoming section of road, such as the gradient of the section of road and/or a speed limit for the section of road.

According to one embodiment of the present invention, the one or a plurality of future velocity profiles $v_{pred}$ are predicted for the actual velocity for the section of road ahead of the vehicle in that the prediction is based on the current position and situation of the vehicle and looks ahead over the section of road, whereupon the prediction is based on a datum concerning the section of road.

For example, the prediction can be made in the vehicle at a predetermined frequency, such as the frequency 1 Hz, which means that a new prediction is completed every second, or at a frequency of 0.1 Hz or 10 Hz. The section of road for which the prediction is made comprises a predetermined stretch ahead of the vehicle, which can be, for example, 0.5 km, 1 km or 2 km long. The section of road can also be viewed as a horizon ahead of the vehicle for which the prediction is to be made.

The prediction can, in addition to the aforementioned parameter road gradient, also be based on one or a plurality of a transmission mode, a driving behavior, a current actual vehicle velocity, at least one engine property, such as a maximum and/or minimum engine torque, a vehicle weight, an air resistance, a rolling resistance, a gear ratio of the transmission and/or driveline, or a wheel radius.

The road gradient on which the prediction can be based can be obtained in a number of different ways. The road gradient can be determined based on cartographic data, e.g. from digital maps containing topographic information, in combination with positioning system information, such as GPS information (Global Positioning System). Using the positioning information, the relationship of the vehicle to the cartographic data can be determined so that the road gradient can be extracted from the cartographic data.

Cartographic data and positioning information are used in many current cruise control systems in connection with cruise control. Such systems can then provide cartographic data and positioning information to the system for the present invention, with the result that the additional complexity involved in determining the road gradient is low.

The road gradient on which the simulations are based can be obtained based on a map in combination with GPS information, on radar information, on camera information, on information from another vehicle, on positioning information and road gradient information previously stored in the vehicle, or on information obtained from a traffic system related to said section of road. In systems in which information exchanges between vehicles can be utilized, a road gradient estimated by one vehicle can be provided to other vehicles, either directly or via an intermediary unit such as a database or the like.

A prediction of at least one future temperature profile $T_{pred}$ for a temperature for at least one component along the section of road is made in a second step 202 of the method, e.g. by means of a temperature prediction unit 302 in the control unit 300. The prediction is based here on at least a tonnage for the vehicle, on the aforedescribed information related to the section of road ahead of the vehicle, and on the at least one future velocity profile $v_{pred}$ predicted in the first step 201.

According to one embodiment of the invention, the at least one component comprises one or a plurality of the cooling fluid, a motor oil in the engine 200, a retarder device, a cylinder material in the engine 200, an exhaust-recirculating device, a turbocharger device, a transmission in the vehicle, a compressor for a brake system in the vehicle, exhaust from the engine 200, a post-processing device for exhaust, such as a catalytic converter and/or a particulate filter, and an air-conditioning system.

According to one embodiment of the invention, the temperature profile $T_{pred}$ can also be based on one or a plurality of the torque delivered by the engine 200, an engine rpm, a gear selection for the vehicle transmission, a component used in the vehicle, an airflow through the radiator 100, an ambient/atmospheric air pressure, an ambient temperature and known properties of engine and/or cooling system units.

The control of the cooling system is performed in a third step 203 of the method according to the present invention, which control can, for example, be performed by a cooling system control unit 303 in the control unit 300, based on the predicted at least one future temperature profile $T_{pred}$ predicted in step 202 and on a limit value temperature $T_{comp_lim}$ for at least one of the components in the vehicle. The limit value temperature $T_{comp_lim}$ in this document is a collective limit value temperature that comprises one or a plurality of limit value temperatures for one or a plurality of the respective components included in the cooling system. The limit value temperature $T_{comp_lim}$ is compared in this document with, e.g. the actual temperature $T_{comp}$, which constitutes a collective temperature comprising one or a plurality of temperatures for the corresponding one or a plurality of respective components included in the cooling system, which are described in greater detail below. The control is carried out according to the present invention with a view to reducing the number of fluctuations, which can be major fluctuations, of an inlet temperature $T_{comp_fluid_in_radiator}$ for the cooling fluid in the radiator 100 and/or with a view to reducing the flow Q in the radiator when a large temperature derivative dT/dt for the inlet temperature $T_{comp_fluid_in_radiator}$ for the radiator is present, i.e. when the temperature derivative dT/dt for the inlet temperature $T_{comp_fluid_in_radiator}$ exceeds a limit value $dT/dt_{lim}$ for said derivative.

According to one embodiment, the limit value $dT/dt_{lim}$ for the derivative is related to changes in the inlet temperature $T_{comp_fluid_in_radiator}$ that entail a risk of causing harmful cycles by the radiator. Here the limit value $dT/dt_{lim}$ is thus set so that such harmful cycles are avoid.

According to one embodiment of the present invention, the limit value $dT/dt_{lim}$ for the derivative is related to the robustness of one or a plurality of the components included in the cooling system, whereupon the limit value $dT/dt_{lim}$ is set to a value that positively affects the robustness of one or a plurality of the components.

According to one embodiment of the present invention, the limit value $dT/dt_{lim}$ for the derivative is related to a temperature dependency for the efficiency of one or a plurality of the components included in the cooling system, whereupon the limit value $dT/dt_{lim}$ is set at a value that positively affects the efficiency of one or a plurality of the components.

According to one embodiment of the present invention, the limit value $dT/dt_{lim}$ for the derivative has the value 4° C./s.

Well-founded and active choices for the control of the cooling system can be made by means of the present invention, as said control is based on both the predicted future temperature profile $T_{pred}$ and on the limit value temperature $T_{comp_lim}$ for the included components. The components can thus be utilized efficiently for the predicted future temperature profile $T_{pred}$ without exceeding/undershooting their limit value temperatures $T_{comp_lim}$. This utilization can here be optimized with respect to the robustness of the included components, i.e. decisions in connection with the control of the cooling system that can extend the service life of the radiator 100 are prioritized.

For many components it is decisive to avoid excessively high temperatures. However, for some components, such as an EGR (Exhaust Gas Recirculation) radiator, it is important to avoid excessively low temperatures in order to avoid precipitation in the form of condensate in the oil.

For example, here the thermostat 120, the water pump 110, the fan 130 and/or the radiator blinds 140 can be adjusted so that radiator wear due to material stresses is reduced, and so that the service life of the radiator 100 increases, e.g. by minimizing the number of changes from a closed to some open position of the thermostat 120.

A number of temperatures are used in this application to describe the present invention and its embodiments. The actual temperatures here indicate instantaneous/existing/prevailing temperatures, which can also be viewed as predictions of temperatures at the current location of the vehicle, i.e. 0 meters in front of the vehicle. Predicted temperatures refer here to estimates of how the temperature will be at various points ahead of the vehicle when it is moving, e.g. in 250 m, 500 m, 1 km or 2 km.

Some of these temperatures are defined as follows:

$T_{comp}$ describes an actual/existing/prevailing/instantaneous temperature for at least one component in the vehicle for which the cooling system is regulating the temperature, wherein e.g. the engine 200 and cooling fluid can constitute such components. The actual temperature $T_{comp}$ thus constitutes a collective temperature comprising one or a plurality of temperatures for one or a plurality of the components included in the cooling system.

$T_{comp_fluid}$ specifically describes an actual temperature for the component cooling fluid. As noted below, there are also special cooling fluid temperatures for other components in the cooling system, as this cooling temperature $T_{comp_fluid}$ varies along the flow of the cooling fluid through the cooling loop. The actual temperature $T_{comp_fluid}$ thus consists of a collective temperature comprising one or a plurality of temperatures for the cooling fluid at one or a plurality of the components included in the cooling system.

$T_{comp_fluid_radiator}$ describes an actual cooling fluid temperature in the component the radiator 100, which constitutes an average temperature for the cooling fluid in the radiator, wherein this average temperature can be estimated based, for example, on an assumed cooling fluid and/or temperature distribution in the radiator, and/or on an ambient temperature.

$T_{comp_fluid_in_radiator}$ describes an actual cooling fluid temperature at an inlet to the component the radiator 100.

$T_{comp_fluid_motor}$ describes an actual cooling fluid temperature in the component the engine 200.

$T_{comp_lim}$ describes a limit value temperature that constitutes an upper/lower limit value temperature for at least one of the components. As is described below, there are also specific limit value temperatures defined for certain of the components, e.g. for a turbocharger or a retarder oil. The limit value temperature $T_{comp_lim}$ is thus a collective limit value temperature, which comprises one or a plurality of limit value temperatures for one or a plurality of the components included in the cooling system. If, for example, the actual temperature $T_{comp}$ is compared to the limit value temperature $T_{comp_lim}$, then a comparison of the actual temperature $T_{comp}$ for one or a plurality of included component temperatures is made to respective component limit value temperatures included in the limit value temperature $T_{comp_lim}$.

$T_{pred}$ describes a prediction of at least one future temperature profile for the at least one component in the vehicle for a section of road lying ahead of the vehicle. In other words, $T_{pred}$ corresponds to an estimate of how the actual temperature $T_{comp}$ will be for the upcoming section of road. The predicted temperature $T_{pred}$ thus constitutes a collective temperature comprising one or a plurality of predicted temperatures for one or a plurality of the components included in the cooling system.

$T_{pred_fluid}$ describes a prediction of a specific temperature for the component cooling fluid. In other words, $T_{pred_fluid}$ corresponds to an estimate of how the actual cooling fluid temperature $T_{comp_fluid}$ will be for the upcoming section of road. The predicted temperature $T_{pred_fluid}$ thus constitutes a collective temperature comprising one or a plurality of predicted temperature for the cooling fluid for one or a plurality of the components included in the cooling system.

$T_{ref}$ describes a reference temperature that indicates when the thermostat 120 is to open and/or close. The reference temperature $T_{ref}$ indicates a temperature $T_{ref}$ at which the thermostat 120 is to open when it is reached from below by an increasing temperature, or is to be closed when reached from above by a decreasing temperature.

dT/dt describes a time derivative, i.e. changes over time. Time derivatives can be determined for the different temperatures in the system, such as the inlet temperature for cooling fluid entering the radiator $T_{comp_fluid_in_radiator}$.

$dT/dt_{lim}$ describes a limit value for the temperature derivative dT/dt for different temperatures in the system, such as the inlet temperature for the cooling fluid entering the radiator $T_{comp_fluid_in_radiator}$. The limit value $dT/dt_{lim}$ can be used to assess essentially all the temperatures described in this document and their derivatives/changes.

According to one embodiment of the invention, for a cold state, i.e. when the surroundings of the vehicle are cold, a cooling power $P_{cooling}$ for the radiator 100 is higher than a cooling power limit value $P_{cooling_thres}$ at the same time as a cooling fluid temperature $T_{comp_fluid_radiator}$ in the radiator is lower than a low cooling fluid limit value $T_{comp_fluid_radiator_thres_cold}$ for the cooling fluid in the radiator 100. The cooling fluid limit value $T_{comp_fluid_radiator_thres_cold}$ can here correspond, for example, to ca. −10° C. The cooling power limit value $P_{cooling_thres}$ can here correspond to, for example, 100 kW.

According to one embodiment of the present invention, the thermostat 120 must be kept closed for as long as possible while in the cold state defined above, whereupon said closed state for the thermostat 120 is based on an analysis of the predicted future temperature profile $T_{pred}$ and one or a plurality of limit value temperatures $T_{comp_lim}$ for one or a plurality of included components. The way in which the predicted future temperature profile $T_{pred}$ for each and every respective component relates to each respective corresponding limit value temperature $T_{comp_lim}$ is thus analyzed.

The prolongation of the closed state $t_{closed}$ of the thermostat 120 is achieved in that a reference temperature $T_{ref}$, which is utilized for opening and closing the thermostat 120 in that the reference temperature $T_{ref}$ indicates when the thermostat is to switch between an open and a closed state, is assigned a maximum permissible value $T_{ref_max}$ if the future temperature profile $T_{pred}$ indicates that the actual temperature $T_{comp}$ for each and every one of the one or a plurality of components will be below the limit value temperature $T_{comp_lim}$ for at least one of the components if limited cooling by means of the radiator is applied. For example, the actual temperature $T_{comp_fluid}$ for the component cooling fluid cannot exceed the limit value temperature $T_{comp_lim}$ because of the prolonged closure of the thermostat 120; $T_{comp_fluid}<T_{comp_lim}$. The maximum permissible value $T_{ref_max}$ can here correspond to, for example, ca. 105° C. A prolonged time $t_{closed}$ with the thermostat closed is thereby achieved before the thermostat 120 switches over to its open state.

Following the prolonged time $t_{closed}$ during which the thermostat 120 was in its closed state, the thermostat will be opened if the actual temperature $T_{comp_fluid}$ of the cooling fluid exceeds the maximum permissible value $T_{ref_max}$. According to one embodiment of the invention, the reference temperature $T_{ref}$ is, during this open state of the thermostat 120, assigned a minimum permissible value $T_{ref_min}$, e.g. a value corresponding to ca. 70° C., which means that the thermostat 120 will switch from its open state to its closed state at said minimum permissible value $T_{ref_min}$. According to this embodiment, the limited cooling will here be utilized to enable the actual temperature $T_{comp_fluid}$ of the cooling fluid to slowly decrease to the minimum permissible value $T_{ref_min}$, at which the thermostat 120 will switch to its closed state.

Assigning the reference temperature $T_{ref}$ the minimum permissible value $T_{ref_min}$ extends a prolonged time $t_{open}$ for the thermostat 120 to be in its open state before the thermostat is closed. However, if the temperature profile $T_{pred}$ indicates that the actual temperature $T_{comp}$ will be higher than the limit value temperature $T_{comp_lim}$ for at least one component $T_{comp}>T_{comp_lim}$, then the condition for the limited cooling will no longer be fulfilled, whereupon the thermostat 120 must meet the cooling demand by opening more, i.e. by conducting a higher flow Q through the radiator 100. After the greater cooling demand has been met by means of a greater degree of opening of the thermostat 120, a reversion to the limited cooling will occur if the temperature profile $T_{pred}$ indicates that the actual temperature $T_{comp}$ will be lower than the limit value temperature $T_{comp_lim}$ for all components $T_{comp}<T_{comp_lim}$.

The actual temperature $T_{comp_fluid}$ of the cooling fluid is thus controlled so as to fall between the minimum $T_{ref_min}$ and maximum $T_{ref_max}$ permissible values; $T_{ref_min}<T_{comp_fluid}<T_{ref_max}$ if the temperature profile $T_{pred}$ indicates that the actual temperature $T_{comp}$ will be lower than the limit value temperature $T_{comp_lim}$; $T_{comp}<T_{comp_lim}$.

In other words, the thermostat 120 is controlled so as to have a longer period time by increasing/decreasing the reference temperature $T_{ref}$ so that the result will be that as few cycles of the radiator 100 as possible will occur if the temperature profile $T_{pred}$ indicates that the temperature $T_{comp}$ for the components during minimum cooling will be less than the limit value temperature $T_{comp_lim}$; $T_{comp}<T_{comp_lim}$. The thermostat 120 here will first open at an increased reference value; $T_{comp_fluid}>T_{ref_max}$; and respectively first close at a reduced reference value; $T_{comp_fluid}<T_{ref_min}$.

The prolonged time $t_{closed}$ during which the thermostat is in its closed state is thus obtained via the controlled assignment of the maximum permissible value $T_{ref_max}$ to the reference temperature $T_{ref}$ when the thermostat 120 is in its closed state. In corresponding fashion, the prolonged time $t_{open}$ during which the thermostat 120 is open is obtained via the controlled assignment of the minimum permissible value $T_{ref_min}$ to the reference temperature $T_{ref}$ when the thermostat is in its open state. Collectively, this yields a prolonged period time between two consecutive openings of the thermostat 120 because larger variations in the actual temperature $T_{comp_fluid}$ for the cooling fluid are permitted. In other words, fewer cycles of the radiator 100 occur because each period takes a longer time, which is less burdensome for the radiator 100. At the same time, the temperature $T_{comp}$ for the components will not exceed the limit value temperature $T_{comp_lim}$ for the respective component, since the assignments of the values to the reference temperature $T_{ref}$ are based on the temperature profile $T_{pred}$. A robust and reliable control of the cooling system that decreases the wear on the radiator 100 and/or the cooling system is consequently obtained through the utilization of the present invention.

According to one embodiment, the aforementioned limited cooling that is to be utilized in the cold state is obtained from a cooling fluid flow Q through the radiator 100 of less than, for example, 5 liters per minute, or less than some other suitable value within the range of 3-6 liters per minute. The limited cooling can also be achieved by utilizing a passive airflow through the radiator, i.e. the flow and the cooling in the cooling system 400 are obtained without the effects of energy-consuming units, such as the pump 110 and/or the fan 130. The limited cooling can also be achieved by means of active adjustment, i.e. by utilizing the pump 110 and/or the fan 130, toward a predefined relatively low reference temperature $T_{ref}$.

Figure 3:
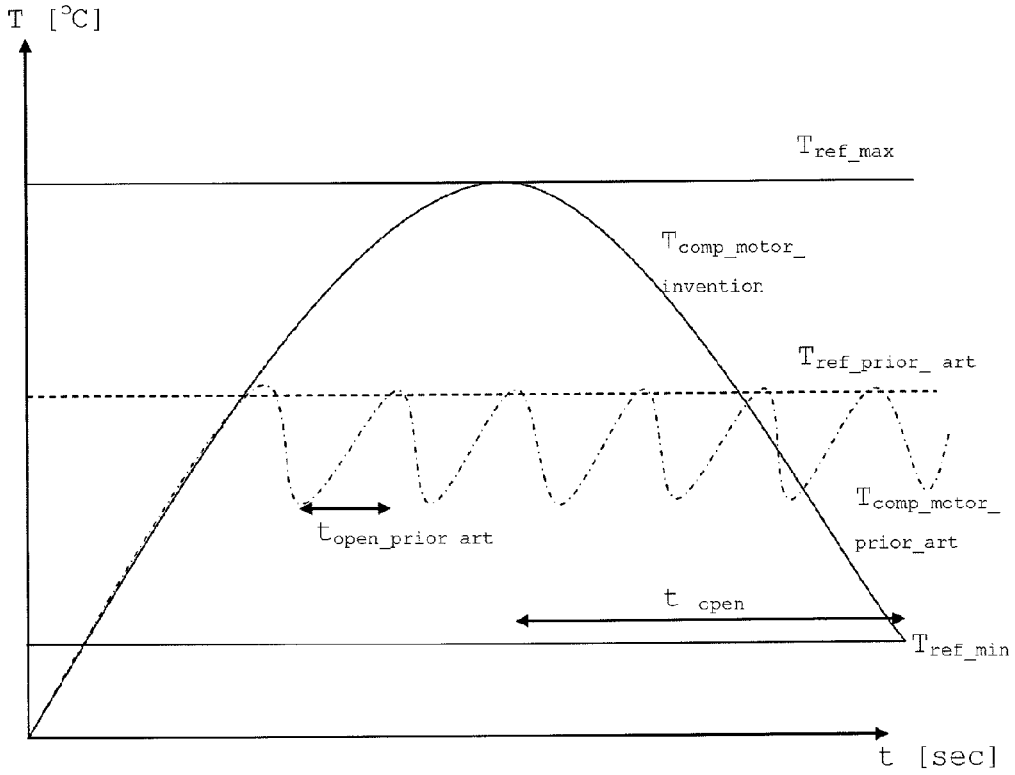
FIG. 3 shows a non-limitative example of the utilization of one embodiment of the invention.

FIG. 3 schematically illustrates a non-limitative example of how an actual temperature T the component the $T_{comp_motor_invention}$ of engine 200 according to the present invention (solid curve) can look when the reference temperature $T_{ref}$ according to the embodiment is assigned the minimum permissible value $T_{ref_min}$ or the maximum permissible value $T_{ref_max}$. For the sake of comparison, an opening/closing temperature $T_{ref_prior\ art}$ (broken line) for a previously known thermostat is also shown, which thermostat opens/closes when the temperature condition $T_{ref_prior\ art}$ is fulfilled in a known manner. The temperature $T_{comp_motor_prior\ art}$ of the engine 200 in which the use of said prior art condition-controlled thermostat based on the opening/closing temperature would result is also shown (dotted curve). It is clear from the example illustrated in FIG. 3 that the time $t_{open}$ the thermostat 120 spends in its open state before the thermostat closes is prolonged, whereupon fewer cycles occur using the embodiment as compared to the prior art; $t_{open}>t_{open_prior\ art}$.

According to one embodiment of the present invention, the radiator 100 is preheated if a predicted inflow $Q_{pred}$ into the radiator 100 exceeds a limit value $Q_{lim}$ for the cold state defined above, i.e. when the surroundings of the vehicle are cold, so that the cooling power $P_{cooling}$ for the radiator 100 is higher than a cooling power limit value $P_{cooling_thres}$ at the same time as a cooling fluid temperature $T_{comp_fluid_radiator}$ in the radiator is lower than a low cooling fluid limit value $T_{comp_fluid_radiator_thres_cold}$ for the cooling fluid in the radiator 100. The predicted inflow $Q_{pred}$ into the radiator 100 is determined here based on the future temperature profile $T_{pred}$, which is in turn determined based on, among other factors, the future velocity profile $v_{pred}$. The radiator 100 is thereby heated up gently before the predicted high inflow $Q_{pred}$ into the radiator, i.e. before the inflow that exceeds the limit value $Q_{lim}$, reaches the radiator 100.

According to one embodiment, said preheating is achieved in that the flow Q into the radiator 100 is gradually increased, whereupon the cooling fluid temperature $T_{comp_fluid_radiator}$ in the radiator is also gradually increased. This means that the predicted major temperature shift in the radiator 100 can be reduced considerably, which reduces the wear on the radiator.

The preheating of the radiator by means of a gradual increase in the flow Q through the radiator can also be supplemented by closing the radiator blinds 140, which produces a decreased airflow, and/or control of the cooling fluid flow through the radiator 100 by means of an adjustable cooling fluid pump 110. The preheating results in a gentle advance elevation of the cooling fluid temperature $T_{comp_fluid_radiator}$ in the radiator 100.

When the preheating of the radiator is completed, limited cooling by means of the radiator 100 can be applied if a temperature derivative dT/dt of the temperature $T_{comp_fluid}$ for the cooling fluid exceeds a change limit value $(dT/dt)_{lim_cold}$. In this document, a temperature derivative consists of a time derivative of the temperature, i.e. a change in the temperature over a time interval. Here the limited cooling is thus utilized when the temperature derivative dT/dt for the temperature $T_{comp_fluid}$ is predicted to be large.

The limited cooling can here be obtained in that an opening of the thermostat 120 is limited to a sufficient extent that the predicted future temperature profile $T_{pred}$ indicates that a temperature $T_{comp}$ for the at least one component is lower than the limit value temperature $T_{comp_lim}$ for the respective component; $T_{comp}<T_{comp_lim}$. The preheating functions here as a buffer, since the actual temperature $T_{comp_fluid}$ of the cooling fluid will be decreased by means of preheating if its predicted temperature derivative dT/dt is greater than the low limit value for the temperature derivative $(dT/dt)_{lim_cold}$. The preheating can then continue until the thermostat 120 can be kept closed at the same time as the temperature derivative dT/dt for the actual temperature $T_{comp_fluid}$ of the cooling fluid is greater than the low limit value for the temperature derivative $(dT/dt)_{lim_cold}$, or if the actual temperature $T_{comp_fluid}$ of the cooling fluid reaches its limit value temperature $T_{comp_lim}$.

The power of the radiator 100 can thus be controlled by controlling the flow Q through the radiator 100, where a reduced Q decreases the heat exchange in the radiator. The flow Q through the radiator 100 is thus minimized if the temperature derivative dT/dt is greater than the low limit value for the temperature derivative $(dT/dt)_{lim_cold}$. Removing energy from the cooling loop in advance, which is achieved by lowering the actual temperature $T_{comp_fluid}$ of the cooling fluid, builds up a buffer that can be utilized when the flow is to be minimized when the temperature derivative dT/dt is greater than the low limit value for the temperature derivative $(dT/dt)_{lim_cold}$. The buffer is thus here built up by utilizing the preheating. The condition that the temperature $T_{comp}$ of the at least one component must be lower than the limit value temperature $T_{comp_lim}$ for the respective component; $T_{comp}<T_{comp_lim}$; determines the extent to which the flow Q through the radiator 100 can be limited.

The thermostat 120 here is thus opened before it would have been opened according to the prior art if it can be confirmed, based on the prediction of the temperature profile $T_{pred}$, that the flow Q through the radiator 100 will exceed the flow limit value $Q_{lim}$. This produces gentle cooling, since "temperature spikes," i.e. short periods in which the temperature derivative dT/dt is extremely high, i.e. when the temperature derivative dT/dt exceeds a limit value $dT/dt_{lim}$ for the derivative, in the temperature $T_{comp_fluid_in_radiator}$ of the cooling fluid at the inlet to the radiator, which would have arisen using the prior art, can be reduced considerably if the thermostat 120 can be kept closed. If, because of the demand for cooling, the thermostat 120 cannot be kept closed, the gentle cooling is obtained via the decreased power that is achieved by means of the reduced flow Q through the radiator 100.

According to one embodiment of the invention, the opening of the thermostat is limited to such an extent that the thermostat remains closed, whereupon the temperature derivative dT/dt for the cooling fluid temperature $T_{comp_fluid_in_radiator}$ at the inlet to the radiator 100 becomes equal to zero, dT/dt=0.

Figure 4:
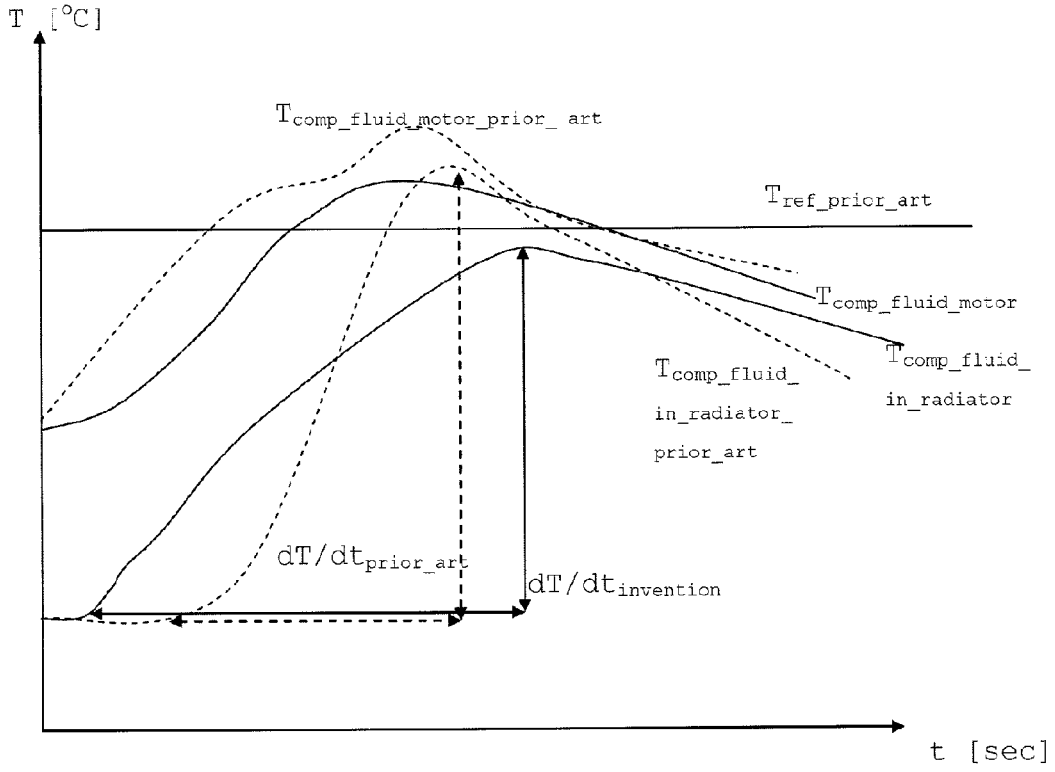
FIG. 4 shows a non-limitative example of the utilization of one embodiment of the invention.

FIG. 4 schematically illustrates a non-limitative example of how a cooling fluid temperature $T_{comp_fluid_motor}$ for the component the engine 200 according to the present invention (solid curve) and the cooling fluid temperature $T_{comp_fluid_in_radiator}$ in the component the radiator 100 (solid curve) can look when the embodiment is applied. For the sake of comparison, there is also illustrated a cooling fluid temperature $T_{comp_fluid_motor_prior_art}$ for the component the engine 200 according to prior art solutions (broken curve) and a corresponding cooling fluid temperature $T_{comp_fluid_in_radiator_prior\ art}$ in the radiator 100 (broken curve), which result from prior art regulation based on the use of a thermostat and an opening/closing temperature $T_{ref_prior\ art}$ for the thermostat 120 (solid line). The figure clearly shows that the preheating by means of the radiator and the limited cooling in order to enable the "temperature spikes" that arose with prior art solutions to be reduced when the present invention is applied; $dT/dT_{invention}<dT/dt_{prior_art}$; which reduces the wear on the radiator 100. In other words, the temperature derivative dT/dt often exceeds the limit value $dT/dt_{lim}$ for the derivative when prior art technology is used. When the present invention is utilized, measures such as reducing the flow into the radiator when the limit value $dT/dt_{lim}$ for the temperature derivative dT/dt is reached are implemented, with the result that flatter curves with lower peak values for the temperature derivative dT/dt are obtained when the invention is applied, which reduces their negative effect/influence on the radiator.

According to one embodiment of the present invention, a pre-cooling of the cooling fluid, i.e. a decrease in the actual cooling fluid temperature $T_{comp_fluid}$, can be applied when the ambient temperature is high, in order to create an energy buffer in the cooling system. The buffer can be utilized at a reduced flow Q into the radiator 100 if the temperature derivative dT/dt for the actual temperature $T_{comp}$ for any of the components is greater than the high limit value for the temperature derivative $(dT/dt)_{lim_warm}$. The temperature change over time, i.e. the temperature derivative dT/dt, can, for example, be great when a retarder brake is being used on a downhill slope, during heavy demand on the engine and/or during exhaust braking. Retarder brakes generate a great deal of heat over a short time, which results in a large derivative for the cooling fluid temperature $T_{comp_fluid}$. A pre-cooling of the cooling fluid $T_{comp_fluid}$ is arranged for here in order to reduce the wear on the radiator 100 if the future temperature profile $T_{pred}$ indicates that a temperature derivative dT/dt for the temperature $T_{comp_fluid}$ for any component will exceed a high limit value for the temperature derivative $(dT/dt)_{lim_warm}$ at the same time as an actual cooling fluid temperature $T_{comp_fluid_radiator}$ in the radiator 100 is higher than a high cooling fluid limit value $T_{comp_fluid_radiator_thres_warm}$ for the cooling fluid in the radiator 100. This high cooling fluid limit value $T_{comp_fluid_radiator_thres_warm}$ for the cooling fluid can, for example, correspond to ca. 60° C. or another suitable temperature within the range from 50° C. to 65° C. According to this embodiment, pre-cooling of the cooling fluid can advantageously be performed at the same time as passive cooling is utilized, i.e. with the thermostat 120 at least partly open.

The pre-cooling is achieved according to this embodiment by opening the thermostat 120, whereupon passive cooling by means of the radiator 100 is performed until the actual cooling fluid temperature $T_{comp_fluid}$ reaches a temperature limit value $T_{comp_fluid_lim}$, for example ca. 60° C., depending on hardware limits, for example when precipitation of condensate in the oil occurs and it cannot be vaporized, and/or the actual temperature $T_{comp}$ for any component reaches its limit value temperature $T_{comp_lim}$ and/or the future temperature profile $T_{pred}$ indicates that a temperature $T_{comp}$ for one or a plurality of components is below the limit value temperature $T_{comp_lim}$ for the respective component. As an example, it can be noted that if the limit value temperature $T_{comp_turbo_lim}$ for a turbocharger has a value corresponding to ca. 125° C., the cooling power needed to avoid exceeding this limit value temperature $T_{comp_turbo_lim}$ will require an actual cooling fluid temperature $T_{comp_fluid}$ corresponding to ca. 90° C. and a flow Q to the radiator corresponding to 400 liters per minute. A buffer is created in the cooling system by means of pre-cooling according to this embodiment, which buffer can, according to the embodiment, be utilized to reduce the flow Q through the radiator 100 during the interval when the change over time dT/dt in the temperature $T_{comp_fluid}$ of the cooling fluid will exceed the high limit value for the temperature derivative $(dT/dt)_{lim_warm}$, so that gentle, limited cooling by means of the radiator 100 is obtained.

According to one embodiment of the invention, the limited cooling of the cooling fluid $T_{comp_fluid}$ is applied after the pre-cooling by means of the radiator 100 has been completed. The future temperature profile $T_{pred}$, on the basis of which the limited cooling is controlled, is here determined taking into account that the temperature derivative dT/dt for the temperature $T_{comp_fluid}$ of the cooling fluid exceeds the high limit value for the temperature derivative $(dT/dt)_{lim_warm}$.

The limited cooling by means of the radiator 100 can then be obtained by opening the thermostat 120 to such a limited extent, i.e. its opening is limited so much, that the future temperature profile $T_{pred}$ indicates that an actual temperature $T_{comp}$ for one or a plurality of components is lower than the limit value temperature $T_{comp_lim}$ for the respective component. The limited opening of the thermostat 120 can here consist of a minimal opening, which can correspond to a closed thermostat 120. The limited cooling by means of the radiator can thus also consist of minimal cooling by means of the radiator 100, which can correspond to a non-cooling by means of the radiator (i.e. the thermostat is closed).

By means of this embodiment, the thermostat 120 is thus controlled so as to maintain a reduced opening of the thermostat 120 throughout the entire course of the large temperature derivative dT/dt for the temperature $T_{comp_fluid}$ of the cooling fluid.

Figure 5:
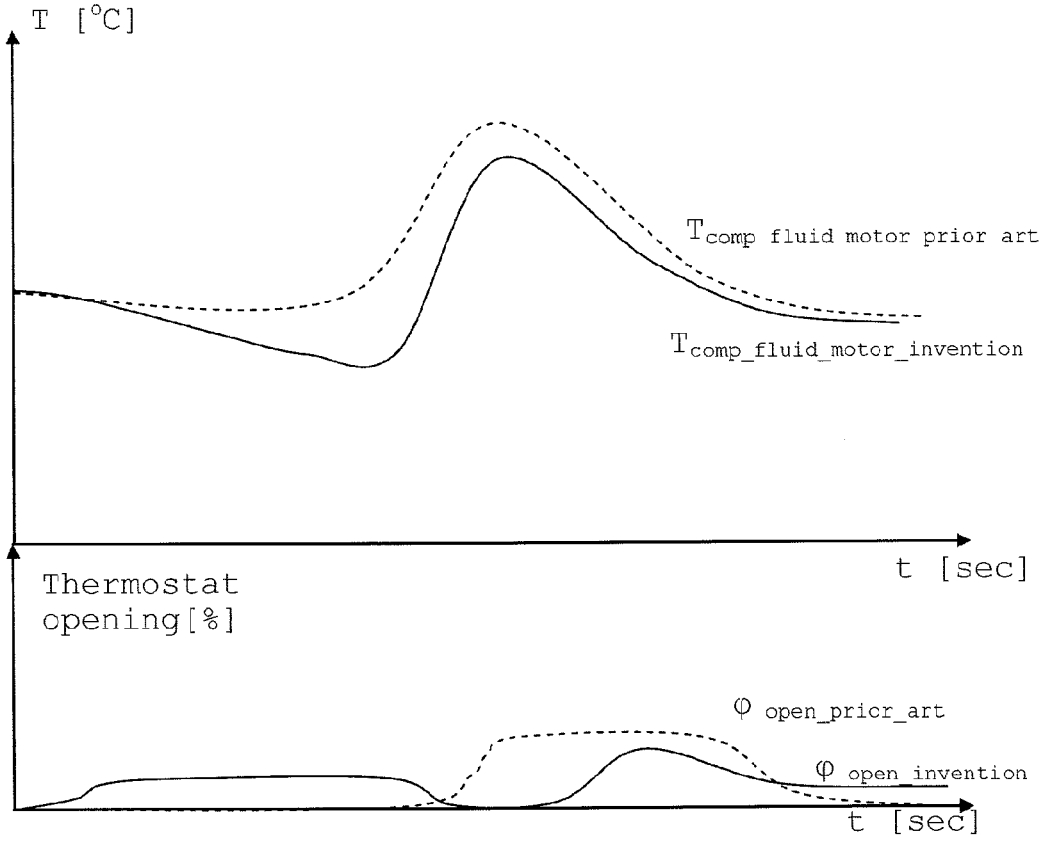
FIG. 5 shows a non-limitative example of the utilization of one embodiment of the invention, FIG. 6 schematically shows a radiator, and FIG. 7 schematically shows a control unit according to the present invention.

FIG. 5 schematically illustrates a non-limitative example of how any actual cooling fluid temperature $T_{comp_fluid_motor\ invention}$ for the component the engine 200 according to the present invention (solid curve) will be the result of a topography with a downhill slope, on which, for example, retarder braking is used, and of a limited thermostat opening $\phi_{open_invention}$ (solid curve) when the embodiment is applied. A cooling fluid temperature $T_{comp_fluid_motor\ prior\ art}$ for the component the engine according to prior art solutions (broken curve) and corresponding thermostat openings $\phi_{open_prior_art}$ (broken curve) for the same topography are also illustrated for the sake of comparison.

FIG. 5 shows that the pre-cooling according to this embodiment creates a buffer fin that the cooling fluid temperature $T_{comp_fluid_motor\ invention}$ according to the invention decreases to a significantly lower value than the cooling fluid temperature $T_{comp_fluid_motor\ prior\ art}$ according to prior art solutions. When the temperature increase begins, the cooling fluid temperature $T_{comp_fluid_motor\ invention}$ according to the invention consequently begins to increase from a considerably lower level, which can be utilized to maintain a minimal flow Q through the radiator, so that gentle, limited cooling by means of the radiator 100 is obtained. Prior art solutions would here have resulted in the risk of a severely increased flow Q to the radiator in a short time, with large changes over time dT/dt in the temperature $T_{comp_fluid}$, which would negatively impact the robustness of the radiator. In prior art solutions, a comprehensive use of the fan 130 would presumably also have been necessary to keep the temperature down, which consumes fuel. The cooling fluid temperature $T_{comp_fluid_motor\ invention}$ for the component the engine according to the invention has higher priority than optimally controlling the flow Q through the radiator 100 in connection with large temperature derivatives dT/dt for the temperature $T_{comp_fluid}$. The flow through the radiator thus cannot be kept down at the expense of one or a plurality of components being at risk of overheating when their respective limit values are exceeded due to the lower flow.

According to one embodiment of the present invention, an inlet temperature $T_{comp_fluid_in_radiator}$ for the cooling fluid in the radiator 100, i.e. the temperature the cooling fluid has when it enters the radiator, is kept essentially constant when the ambient temperature is high and if a temperature imbalance is predicted to arise in the cooling system. According to this embodiment, the upcoming temperature imbalance in the cooling system is thus identified by analyzing the future temperature profile $T_{pred}$. Such a temperature imbalance can arise, for example, in various types of driving situations, e.g. due to variations in topography or velocity. One example of such a driving situation is a rolling motorway, on which, for example, the engine load changes during forward travel because of the topography. The ambient temperature here will be high if an actual cooling fluid temperature $T_{comp_fluid}$ is higher than a high cooling fluid limit value $T_{comp_fluid_thres_warm}$ for the cooling fluid in the radiator 100, where the high cooling fluid limit value $T_{comp_fluid_thres_warm}$ can have a value corresponding to ca. 90° C. An essentially constant inlet temperature $T_{comp_fluid_in_radiator}$ for the radiator 100 can be achieved by pre-controlling the cooling system so as to meet a predicted cooling demand. The predicted cooling demand is here determined based on the future temperature profile $T_{pred}$.

Predicting the future cooling demand makes it possible to make a decision as to whether to utilize an active control of the cooling fluid pump and/or of the thermostat 120, which are then controlled so that the minor fluctuations in the cooling demand can be met by means of the variable cooling performance. An essentially constant inlet temperature $T_{comp_fluid_in_radiator}$ for the radiator is thus achieved by means of pre-control.

Figure 6:
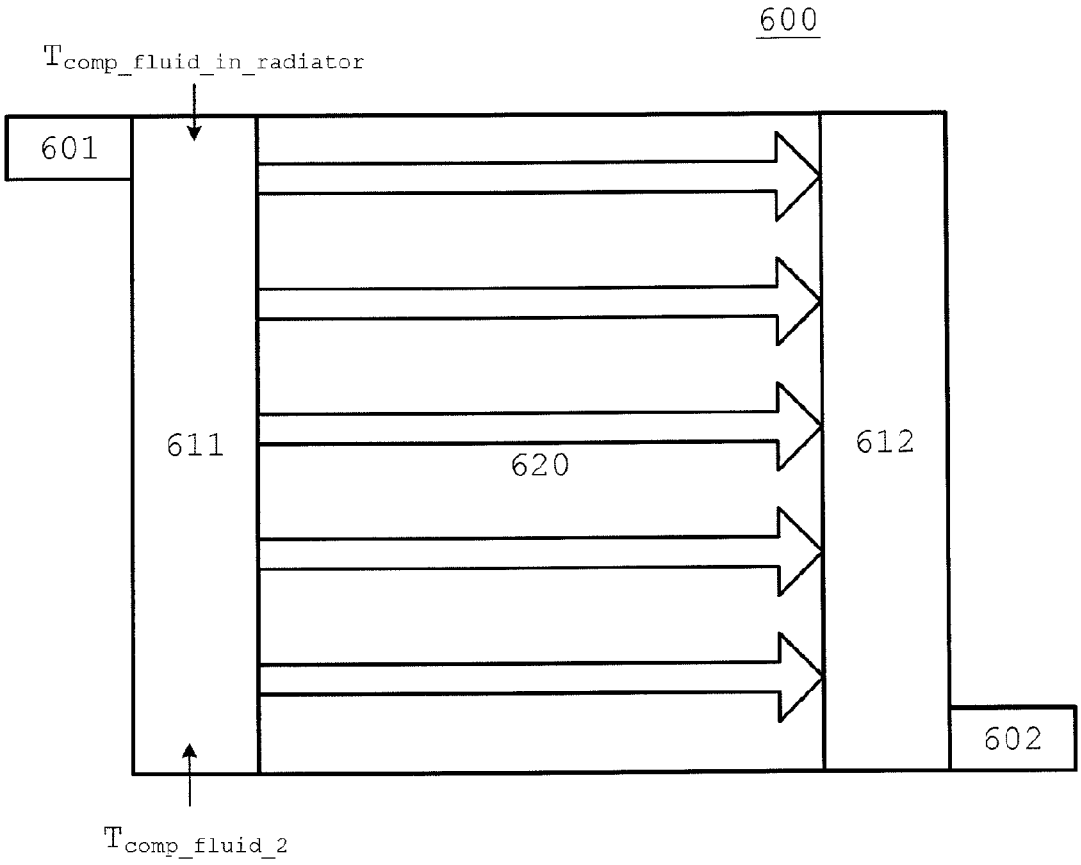

FIG. 6 schematically shows a radiator 600 that has an inlet 601 and an outlet 602, whereby cooling fluid can pass into 610 and out of 602 the radiator 600. A first container 611 is arranged at the inlet 601 and connected to the inlet 601, from which container a number of cooling channels 620 extend to a second container 612, which is connected to the cooling channels 620. The cooling fluid that arrives at the radiator 600 has an inlet temperature $T_{comp_fluid_in_radiator}$ at the inlet 601. The inlet is arranged in a first end of the first container 611. When the cooling fluid passes through the first container 611, its temperature is changed, and at the second end of the container the cooling fluid has a second temperature $T_{comp_fluid_2}$ that is lower than the inlet temperature $T_{comp_fluid_in_radiator}$ at the inlet 601. Pre-controlling, according to the invention, the cooling system so as to meet a predicted cooling demand produces an essentially constant inlet temperature $T_{comp_fluid_in_radiator}$ for the radiator, which also means that equilibrium is achieved between the second temperature $T_{comp_fluid_2}$ and the inlet temperature $T_{comp_fluid_in_radiator}$, wherein said equilibrium results in a relatively small temperature difference between the second temperature $T_{comp_fluid_2}$ and the inlet temperature $T_{comp_fluid_in_radiator}$.

Without the pre-control of the cooling system according to this embodiment, the inlet temperature $T_{comp_fluid_in_radiator}$ at the inlet 601 could vary considerably more than if this embodiment of the invention is utilized. Major variations would yield a higher temperature derivative dT/dt, which would also result in harmful cycling of the radiator 600.

One skilled in the art will perceive that a method for controlling a cooling system according to the present invention could also be implemented in a computer program which, when executed in a computer, would cause the computer to perform the method. The computer program normally consists of a part of a computer program product 703, wherein the computer program product contains a suitable digital storage medium on which the computer program is stored. Said computer-readable medium consists of a suitable memory, such as a: ROM (Read-Only Memory), PROM (Programmable Read-Only Memory), EPROM (Erasable PROM), Flash memory, EEPROM (Electrically Erasable PROM), a hard drive unit, etc.

Figure 7:
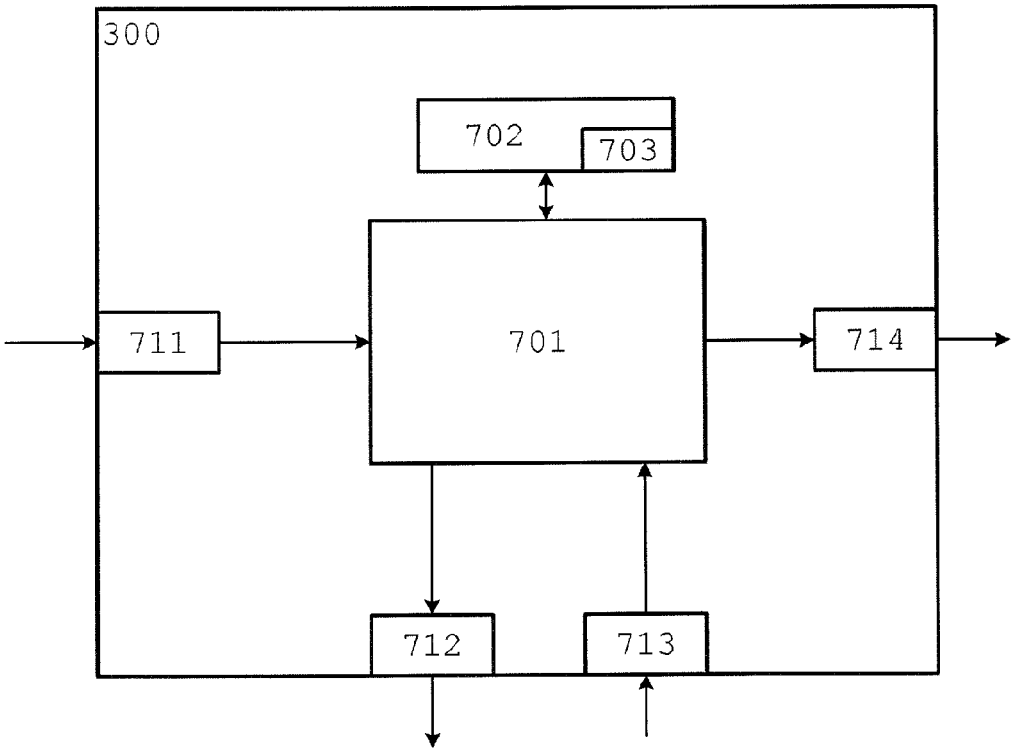

FIG. 7 schematically shows a control unit 300. The control unit 300 contains a calculating unit 701, which can consist of essentially any suitable type of processor or microcomputer, e.g. a circuit for digital signal processing (Digital Signal Processor, DSP), or a circuit with a specific predetermined function (Application Specific Integrated Circuit, ASIC). The calculating unit 701 is connected to a memory unit 702 arranged in the control unit 300, which memory unit supplies the calculating unit 701 with, for example, the stored program code and/or the stored data that the calculating unit 701 requires to be able to perform calculations. The calculating unit 701 is also arranged so as to store partial or final results of calculations in the memory unit 702.

The control unit 300 is further equipped with devices 711, 712, 713, 714 for respectively receiving and transmitting the respective input and output signals. These respective input and output signals can contain waveforms, pulses or other attributes that can be detected by the devices 711, 713 for receiving input signals as information, and can be converted into signals that can be processed by the calculating unit 701. These signals are then supplied to the calculating unit 701. The devices 712, 714 for transmitting output signals are arranged so as to convert signals received from the calculating unit 701 to create output signals by, for example, modulating the signals, which can be transferred to other parts of the cooling system.

Figure 1:
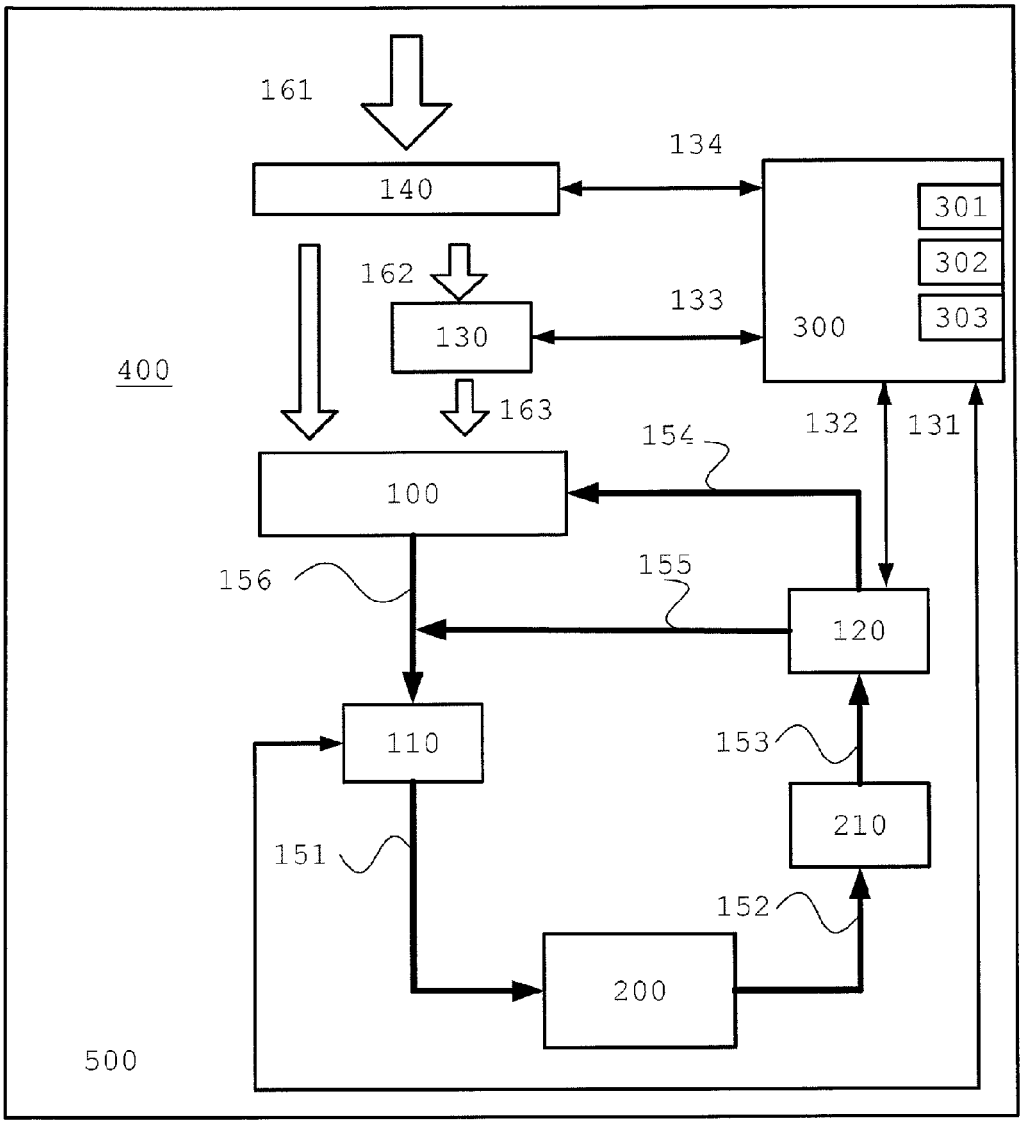

Each and every one of the connections to the devices for receiving and transmitting respective input and output signals can consist of one or a plurality of a cable; a data bus, such a CAN bus (Controller Area Network bus), a MOST bus (Media Orientated Systems Transport bus) or another bus configuration; or of a wireless connection. The connections 131, 132, 133, 134 shown in FIG. 1 can also consist of one or a plurality of said cables, buses or wireless connections.

One skilled in the art will perceive that the aforementioned computer can consist of the calculating unit 701, and that the aforementioned memory can consist of the memory unit 702.

Control systems in modern vehicles generally consist of a communication bus system consisting of one or a plurality of communication buses for linking together a number of electronic control units (ECUs), or controllers, and various components located on the vehicle. Such a control system can contain a large number of control units, and the responsibility for a specific function can be shared among more than one control unit. Vehicles of the type shown thus often contain significantly more control units that are shown in FIG. 7, as will be well known to one skilled in the art in this technical field.

The present invention is implemented in the control unit 300 in the embodiment shown. However, the invention can also be implemented wholly or partly in one or a plurality of control units already present in the vehicle, or in a dedicated control unit for the present invention.

A control system arranged for controlling the aforedescribed cooling system in a vehicle is provided according to one aspect of the present invention. The control system comprises a velocity prediction unit 301 (shown in FIG. 1), which is arranged so as to make, in the manner described above, a prediction of at least one future velocity profile $v_{pred}$ for a velocity of the vehicle, wherein said prediction can be based on information related to the upcoming section of road. The control system further comprises a temperature prediction unit 302 (shown in FIG. 1), which is arranged so as to make a prediction of at least one future temperature profile $T_{pred}$ for a temperature for the at least one component 200, 210, which is based on the tonnage of the vehicle, on information related to the section of road lying ahead of said vehicle, and on the at least one future velocity profile $v_{pred}$. The control system also comprises a cooling system control unit 303 (shown in FIG. 1), which is arranged so as to carry out the control of the cooling system based on the at least one future temperature profile $T_{pred}$ and on a limit value temperature $T_{comp_lim}$ for the respective at least one component 200, 210 in the vehicle. The control is carried out so that the number of fluctuations of an inlet temperature $T_{comp_fluid_in_radiator}$ for the cooling fluid in the radiator 100 is reduced and/or so that a magnitude of the flow Q into the radiator 100 is reduced when a large temperature derivative dT/dt for the inlet temperature $T_{comp_fluid_in_radiator}$ is present, i.e. if the temperature derivative dT/dt is greater than the limit value $dT/dt_{lim}$ for the derivative.

Through the utilization of the control system according to the present invention, the flows in the cooling system are controlled so that the wear on the radiator 100 and/or other components in the cooling system is reduced. For example, the thermostat 120, the water pump 110, the fan 130 and/or the radiator blinds 140 can be adjusted so that the magnitude, frequency and/or direction of changes in the material stresses in components is reduced. The service life of the radiator 100 and/or the cooling system 400 is also extended thereby.

One skilled in the art will also perceive that the foregoing system can be modified in accordance with the various embodiments of the method according to the invention. The invention also concerns a motor vehicle 500, e.g. a goods vehicle or a bus, containing at least one cooling system.

The present invention is not limited to the embodiments described above, but rather concerns and encompasses all embodiments within the protective scope of the accompanying independent claims.

The invention claimed is:

1. A method for controlling a cooling system in a motor vehicle, wherein said cooling system regulates a temperature for at least one component in said vehicle and said cooling system includes a radiator connected to a thermostat controlling a flow of cooling fluid through said radiator, wherein said method comprises:

predicting at least one future velocity profile for a velocity of said vehicle along a section of road ahead of said vehicle;

predicting at least one future temperature profile for a temperature of said at least one component along said section of road, wherein said prediction of said at least one future temperature profile is based on at least a tonnage of said vehicle, on information related to said section of road, and on said at least one future velocity profile; and said controlling said cooling system is based on said at least one future temperature profile and on a limit value temperature for said at least one component in said vehicle, wherein if a temperature derivative for an inlet temperature for said cooling fluid in said radiator exceeds a limit value for said temperature derivative, then said controlling of said cooling system is carried out so that a reduction is achieved in at least one of a number of fluctuations in said inlet temperature; and a size of a flow into said radiator.

2. A method according to claim 1, wherein a cooling power of said radiator exceeds a cooling power limit value, and a cooling fluid temperature in said radiator is lower than a low cooling fluid limit value of said cooling fluid in said radiator.

3. A method according to claim 2, wherein said cooling power limit value corresponds to 100 kW, and said cooling fluid limit value corresponds to a temperature in the range from 0° C. to −10° C.

4. A method according to claim 2, further comprising:

when said thermostat is closed, assigning a reference temperature indicating when said thermostat is to switch from a closed to an open state based on said future temperature profile, wherein the assigning comprises assigning, a maximum permissible value as the reference temperature when said future temperature profile indicates that said temperature for said cooling fluid for at least one component will be lower than said limit value temperature for the respective component if limited cooling by said radiator is applied, whereby a prolonged time with a closed thermostat is obtained before said thermostat is opened.

5. A method according to claim 4, wherein, when said thermostat has opened, the assigning said reference temperature comprises assigning a minimum permissible value and using said limited cooling during the time in which said temperature for said cooling fluid is decreasing toward said minimum permissible value, resulting in a prolonged time with said thermostat open is obtained before said thermostat is closed.

6. A method according to claim 5, wherein said prolonged time with said thermostat closed and said prolonged time with said thermostat open collectively result in a prolonged period of time between two consecutive openings of said thermostat.

7. A method according to claim 5, wherein said maximum permissible value corresponds to about 105° C. and said minimum permissible value corresponds to about 70° C.

8. A method according to claim 4, wherein said limited cooling is defined by at least one of the group consisting of:

a flow of less than 5 liters per minute through said radiator;

a passive airflow through said radiator; and actively controlling said limited cooling so that a cooling fluid temperature is controlled toward a predefined relatively low reference temperature.

9. A method according to claim 1, further comprising:

preheating said cooling fluid when a predicted inflow Q into said radiator, which is determined based on said future temperature profile exceeds an inflow limit value, and when a cooling power for said radiator exceeds a cooling power limit value, and a cooling fluid temperature in said radiator is lower than a low cooling fluid limit value for said cooling fluid in said radiator.

10. A method according to claim 9, wherein said preheating is achieved by gradually increasing the size of the flow into said radiator, whereby said cooling fluid temperature is increased.

11. A method according to claim 10, further comprising:

when performing said gradual increasing of said flow Q into said radiator, taking at least one measure of the group consisting of:

closing of a radiator blind; and controlling the cooling fluid flow into said radiator by an adjustable cooling water pump.

12. A method according to claim 9, further comprising when said preheating of said cooling fluid is performed, applying limited cooling by said radiator if a temperature derivative for a temperature for said cooling fluid for said at least one component is predicted to exceed a limit value for the temperature derivative.

13. A method according to claim 12, wherein said limited cooling comprises limiting an opening of said thermostat so that said future temperature profile indicates that, for every said at least one component, said future temperature profile is lower than said limit value temperature for the respective component.

14. A method according to claim 13, wherein said limiting of said opening results in said thermostat being closed.

15. method according to claim 1, further comprising arranging pre-cooling of said cooling fluid if said future temperature profile indicates that a temperature derivative for an actual temperature for any of said at least one components is greater than a high limit value for the temperature derivative when a cooling fluid temperature in said radiator is higher than a high cooling fluid limit value for said cooling fluid in said radiator.

16. A method according to claim 15, wherein said high cooling fluid limit value for said cooling fluid corresponds to about 60° C.

17. A method according to claim 15, wherein said pre-cooling is achieved by opening of said thermostat followed by passive cooling of said cooling fluid.

18. A method according to claim 15, wherein said pre-cooling continues until at least one occurrence in the group consisting of:

said cooling fluid temperature reaches a temperature limit value;

said cooling fluid temperature reaches said limit value temperature for said cooling fluid; and said future temperature profile indicates that a temperature for any of said at least one components does not exceed said limit value temperature.

19. A method according to claim 15, further comprising:

determining said future temperature profile based on said temperature derivative for said temperature for said cooling fluid exceeding a high limit value for said temperature derivative, wherein limited cooling by said radiator is applied after said pre-cooling of said cooling fluid.

20. A method according to claim 15, wherein said limited cooling is obtained when said temperature derivative for said temperature for said cooling fluid exceeds a high limit value for the temperature derivative, wherein an opening of said thermostat is limited so that said future temperature profile indicates that a temperature for said at least one component is lower than said limit value temperature for said at least one component.

21. A method according to claim 20, wherein said limitation of said opening results in said thermostat being closed.

22. A method according to claim 1, further comprising causing the inlet temperature at an inlet end of a container of said radiator to be essentially constant if a cooling fluid temperature in said radiator is higher than a high cooling fluid limit value for said cooling fluid in said radiator, and if said future temperature profile indicates a future temperature imbalance in said cooling system, wherein the inlet temperature at the inlet end of the container is essentially constant when the inlet temperature is at or is approaching equilibrium with a second temperature at a second end of the container of the radiator, the second end being distal to the inlet end.

23. A method according to claim 22, wherein said high cooling fluid limit value has a value corresponding to about 90° C.

24. A method according to claim 22, further comprising achieving said essentially constant inlet temperature by pre-controlling said cooling system to meet a predicted cooling demand, wherein said predicted cooling demand is determined based on said future temperature profile, wherein the inlet temperature at the inlet end of the container is essentially constant when the inlet temperature is at or is approaching equilibrium with a second temperature at a second end of the container of the radiator, the second end being distal to the inlet end.

25. A method according to claim 1, wherein said at least one component comprises at least one of the group consisting of:

said cooling fluid;

a motor oil;

a retarder device;

a cylinder material in an engine;

an exhaust recirculation device;a turbocharger;

a dual turbocharger;

a transmission;

a compressor for a brake system;

exhaust from an engine;

a post-processing device for exhaust; and an air-conditioning system.

26. A method according to claim 1, wherein said information related to said section of road includes a road gradient.

27. A method according to claim 26, wherein said information relating to said section of road includes said road gradient that is determined based on information selected from the group consisting of:

radar-based information;

camera-based information;

information obtained from a vehicle other than said vehicle;

road gradient information and positioning information previously stored in said vehicle; and information obtained from a traffic system related to said section of road.

28. A method according to claim 1, wherein said information related to said section of road includes at least one selected from the group consisting of:

a driving resistance acting upon said vehicle;

a speed limit for said section of road;

a velocity history for said section of road; and traffic information.

29. A method according to claim 1, wherein said prediction of said at least one future temperature profile is also based on at least one from the group consisting of:

a predicted torque delivered by said engine;

an rpm for said engine;

a gear selection for a transmission in said vehicle;

a component use in said vehicle;

an airflow through said radiator;

an ambient air pressure; and an ambient temperature.

30. A system arranged for controlling a cooling system in a motor vehicle, wherein said cooling system is configured to regulate a temperature for at least one component in said vehicle, and said cooling system comprises a radiator connected to a thermostat controlling a flow of cooling fluid through said radiator, said system comprising:

a velocity prediction unit configured to predict at least one future velocity profile for a velocity of said vehicle over a section of road ahead of said vehicle;

a temperature prediction unit, configured to predict at least one future temperature profile for a temperature for said at least one component over said section of road, wherein said prediction of the at least one future temperature profile is based on at least a tonnage for said vehicle, on information related to said section of road and on said at least one future velocity profile; and a cooling system controller configured and operable to control said cooling system based on said at least one future temperature profile and on a limit value temperature of said at least one component in said vehicle, wherein, if a temperature derivative for an inlet temperature for said cooling fluid into said radiator exceeds a limit value for said temperature derivative, said cooling system controller is configured to control said cooling system to achieve a reduction of at least one of:

a number of fluctuations in an inlet temperature for said cooling fluid into said radiator; and a magnitude of a flow into said radiator.

31. A cooling system in a motor vehicle, and a control system configured to control the cooling system and comprising a non-transitory computer-readable medium incorporating a computer program, said control system comprising: a velocity predictor configured to predict a future velocity profile for a velocity of the motor vehicle over a section of road ahead of the motor vehicle; a temperature predictor configured to predict a future temperature profile for a temperature for a component over the section of road, wherein the prediction of the future temperature profile is based on at least a tonnage for the motor vehicle, on information related to the section of road, and the future velocity profile; said cooling system comprising a radiator connected to a thermostat controlling a flow of cooling fluid through said radiator, and said cooling system is configured to regulate the temperature of said component of the motor vehicle; and said control system configured to control said cooling system based on a the future temperature profile and on a limit value temperature of the component in the motor vehicle; wherein, when a temperature derivative for an inlet temperature for the cooling fluid into said radiator exceeds the limit value for the temperature derivative, said control system is configured to control said cooling system to achieve a reduction of at least one of: a number of fluctuations in the inlet temperature for the cooling fluid into said radiator; and a magnitude of a flow into said radiator.

* * * * *